US008621962B1

(12) United States Patent
Stadnyk

(10) Patent No.: US 8,621,962 B1
(45) Date of Patent: Jan. 7, 2014

(54) DRAIN REMOVAL TOOL

(76) Inventor: Frank W. Stadnyk, Osoyoos (CA)

( * ) Notice: Subject to any disclaimer, the term of this patent is extended or adjusted under 35 U.S.C. 154(b) by 224 days.

(21) Appl. No.: 13/252,584

(22) Filed: Oct. 4, 2011

(51) Int. Cl.
*B25B 13/48* (2006.01)

(52) U.S. Cl.
USPC ..... 81/52

(58) Field of Classification Search
USPC ..... 81/52, 53.2, 3.45
See application file for complete search history.

(56) References Cited

U.S. PATENT DOCUMENTS

| | | | | | |
|---|---|---|---|---|---|
| 1,687,727 | A | * | 10/1928 | Judge | 81/53.2 |
| 1,863,046 | A | | 9/1946 | Rosan | |
| 2,863,348 | A | | 12/1958 | Conger | |
| 3,654,690 | A | | 4/1972 | Hardin | |
| D311,315 | S | * | 10/1990 | Duke | D8/25 |
| 5,054,179 | A | | 10/1991 | Rini | |
| 5,906,146 | A | | 5/1999 | Arlen | |
| 5,946,990 | A | | 9/1999 | Bonacci | |
| 6,237,168 | B1 | | 5/2001 | Daniel, III et al. | |
| 6,282,999 | B1 | | 9/2001 | Hite et al. | |
| 7,013,764 | B2 | * | 3/2006 | Leatherby | 81/176.15 |
| 2004/0255727 | A1 | * | 12/2004 | Kovach | 81/176.15 |
| 2010/0005932 | A1 | * | 1/2010 | Young et al. | 81/124.2 |

OTHER PUBLICATIONS

Internal Wrench Model 342. Ridgid. http://www.ridgid.com/Tools/Internal-Wrench.

8 Pc. Jumbo easy Out Set Screw Extractor DescoUSA. http:///www.toolprice.com/product/l225D/Screw-Extractor--Bolt--Stud-Extractor--Bolt-Removal.html.

* cited by examiner

*Primary Examiner* — David B Thomas
(74) *Attorney, Agent, or Firm* — Montgomery Patent & Design; Robert C. Montgomery

(57) ABSTRACT

A drain removal tool to aid in the removal of drains from tubs, sinks, and showers comprises a conical body having counter-clockwise threads upon the exterior surface. A top of the body is provided with a ratchet connector, allowing the device to be connected to a ratchet tool. In use, a user threads the body into a base of a drain opening. The thread slowly engages a drain flange and drives it out when torque is reversed, thereby ejecting the drain in without damaging or breaking the bottom of the drain.

16 Claims, 5 Drawing Sheets

DRAIN REMOVAL TOOL

RELATED APPLICATIONS

There are no current co-pending applications.

FIELD OF THE INVENTION

A tool designed to aid in the removal of a drain from a basin.

BACKGROUND OF THE INVENTION

As anyone who performs a lot of physical work will attest, nothing beats having the proper tool for a job. The proper tool can save time and money, produce a higher quality job, reduce damage to equipment, and provide for the increased safety of the worker. Each field of physical work has its own type of specialty tools, each performing a specialized task. Plumbing is one of these fields in which very specific tools perform very specific tasks that would otherwise be almost impossible to perform.

One (1) task that is commonly performed in many types of plumbing repairs is the removal of the drain flange from basins of tubs, sinks, showers, and the like. Current tools produced for performing this task typically break the bottom of the drain, requiring additional repair work and resulting in additional time for the plumber and costs for the consumer. Accordingly, there exists a need for a means by which drain flanges from tubs, sinks, showers, and the like can be easily removed without the disadvantages of current methods.

SUMMARY OF THE INVENTION

The principles of the present invention provide for a drain removal tool insertable into a drain flange of a basin to assist in removing said drain flange for subsequent repair of the basin or drain flange.

An aspect of the invention provides for a resilient and durable drain removal tool comprising unitary device having a head portion and a shaft portion, wherein the head portion is adapted to receive an auxiliary driving tool to drive said drain removal tool, and said shaft portion is adapted to be inserted into and firmly grasp an inner surface of said drain flange.

A further aspect of the invention is to provide a cylindrical shape of the head portion and a conical shape of the shaft portion, wherein the shaft portion tapers downward from the head portion to a terminal end.

A further aspect of the invention is to provide a tool attachment recess centrally located on an upper surface of the head portion, preferably comprising a size and shape to adaptably receive a common three-eighths (%) size ratchet head for the auxiliary tool.

Yet another aspect of the invention is to provide the shaft portion with a spiraling set of left-handed threads with pointed threads on an outer surface of the shaft.

Yet another further aspect of the invention is to provide a method where the shaft portion of the drain removal tool is inserted into a drain flange having a through-hole and the auxiliary hole is inserted into the tool attachment recess, such that a counter-clockwise driving force on the auxiliary tool is transferred to the drain removal tool, such that the left-handed pointed threads on the shaft portion engage an inner surface of the drain flange, thereby enabling the drain flange to disengage from the basin simultaneously with the driving force of the auxiliary tool.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
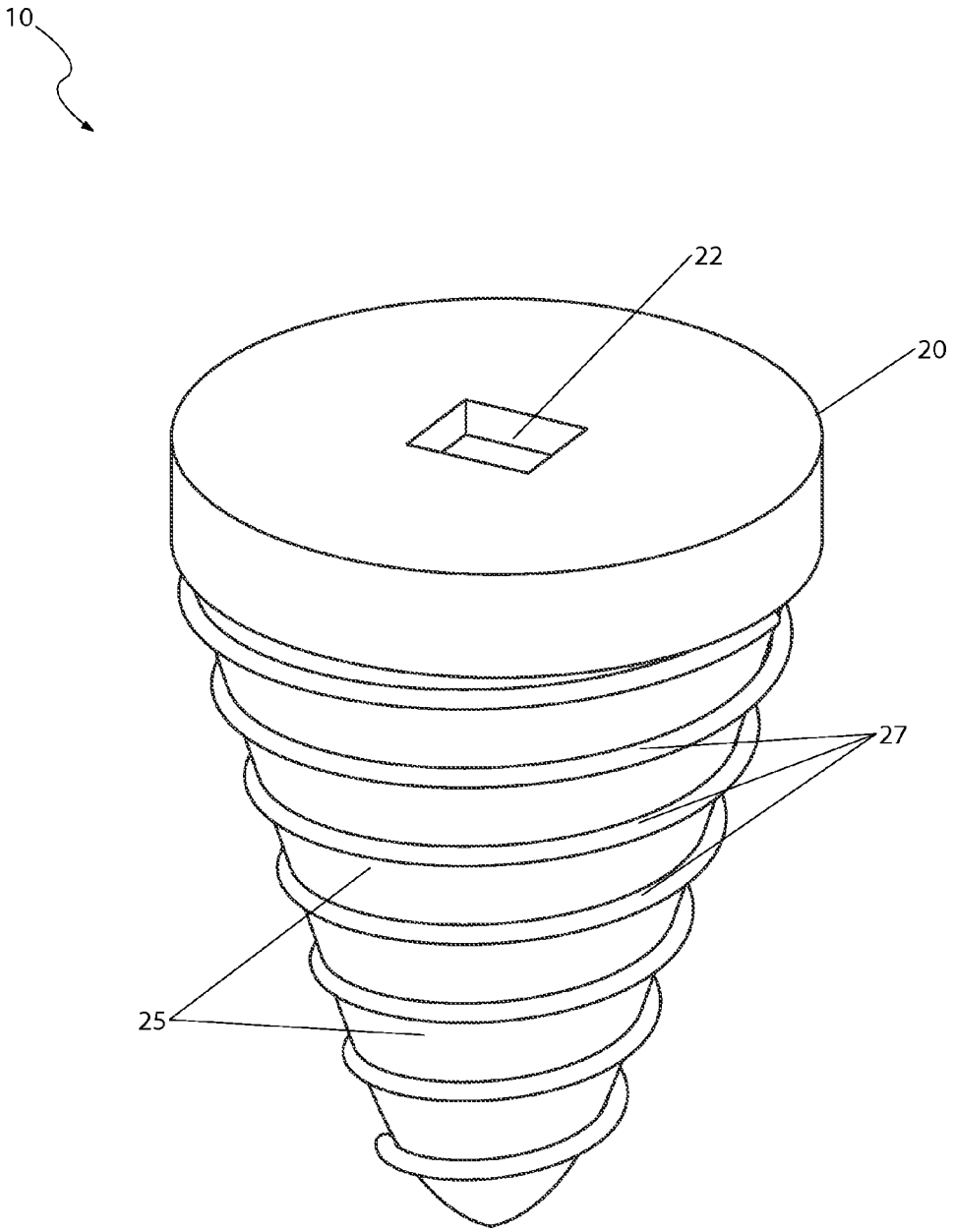
FIG. 1 is a perspective view of a drain removal tool 10, according to a preferred embodiment of the present invention.

10 drain removal tool
11 drain pipe
12 drain flange
20 head
22 tool attachment recess
25 shank
27 thread

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a drain removal tool (herein described as the "device") 10, which provides a means for a user to remove a drain flange 12 from a drain 11 within a bathtub, sink, or the like. The drain flange 12 interconnects the bathtub, sink, or the like to the drain pipe 11 and over time may need replaced due to damage, preventative maintenance, aesthetics, or the like.

Figure 2:
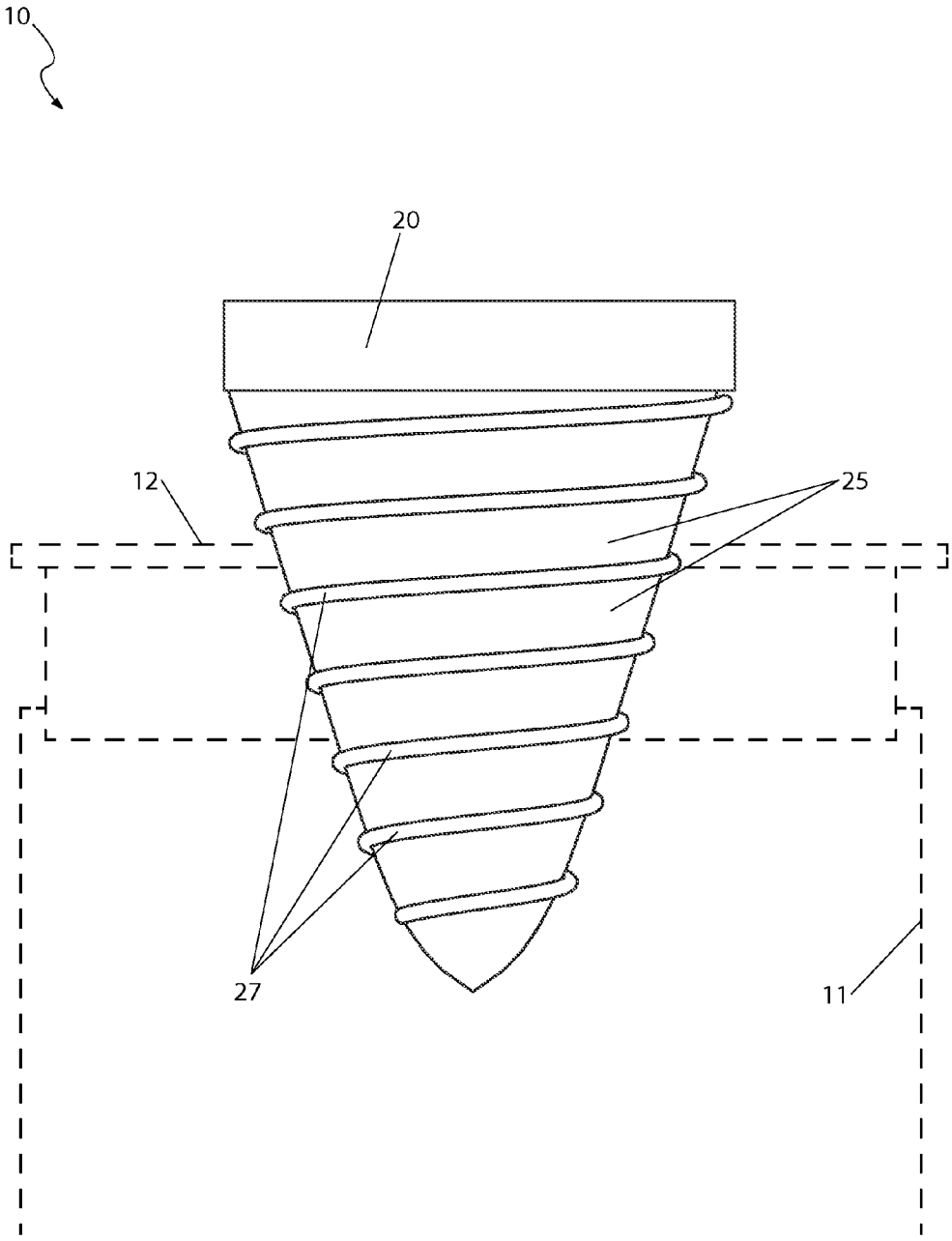
FIG. 2 is a front view of the drain removal tool 10 illustrating insertion into the drain flange 12, according to a preferred embodiment of the present invention.
Figure 3:
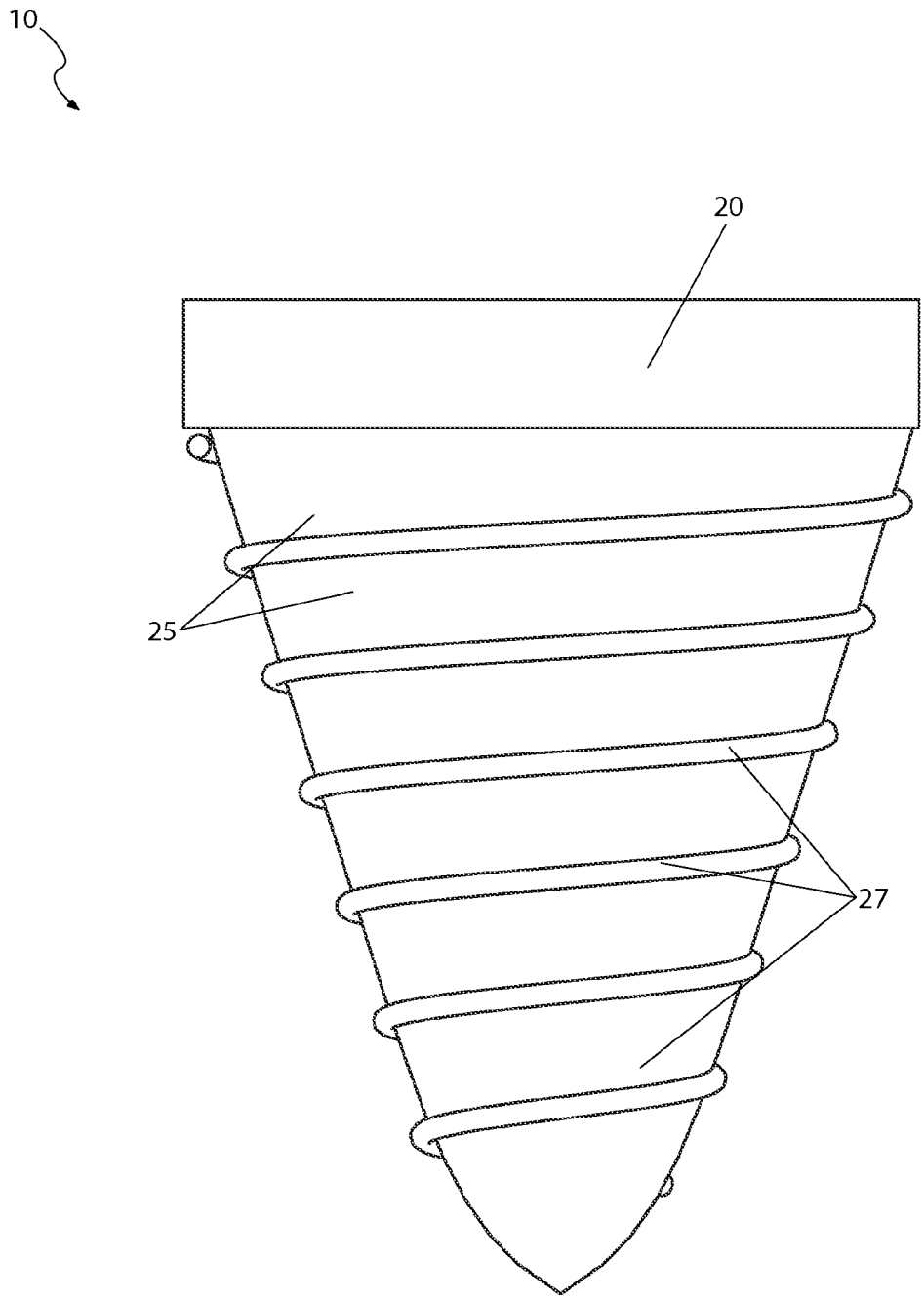
FIG. 3 is a rear view of the drain removal tool 10, according to a preferred embodiment of the present invention.
Figure 4:
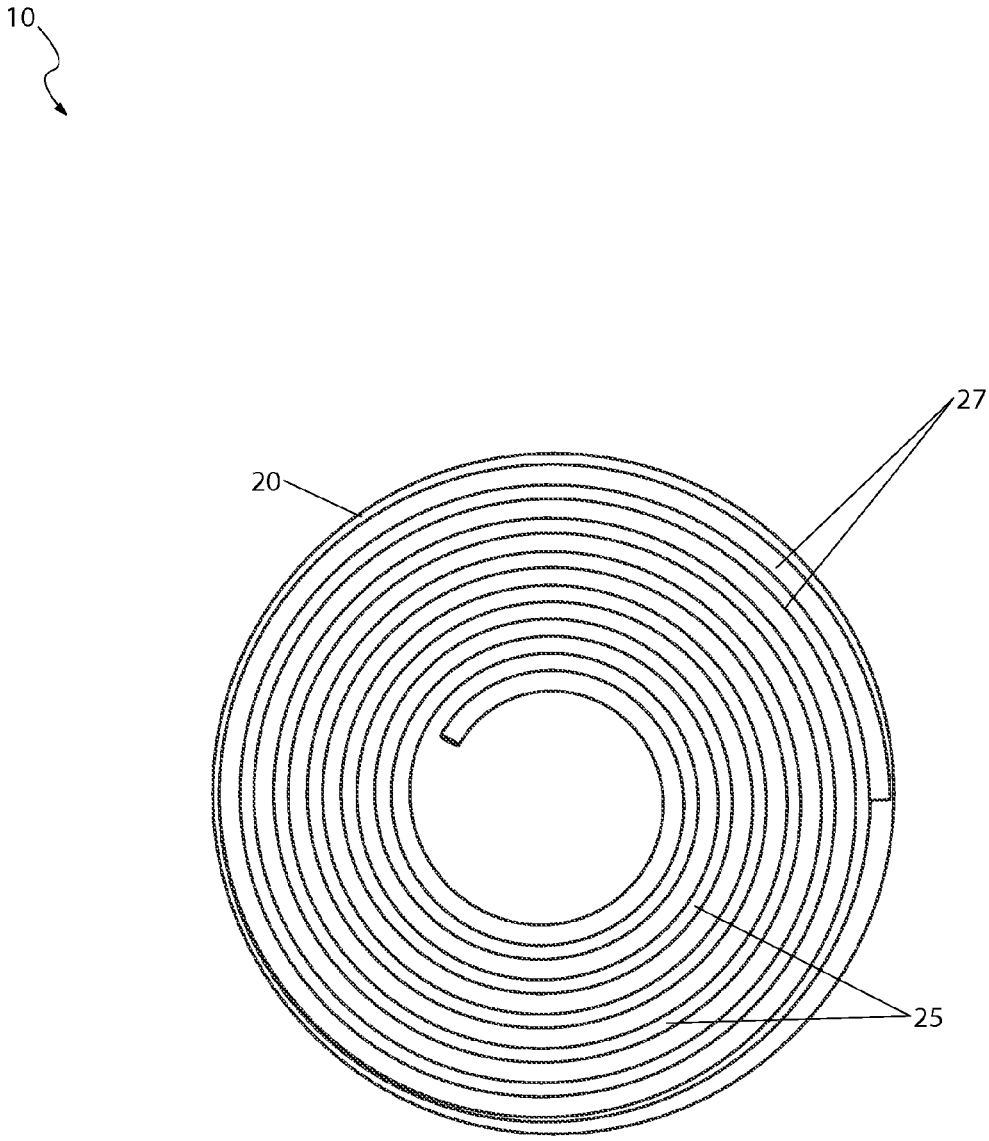
FIG. 4 is a bottom view of the drain removal tool 10, according to a preferred embodiment of the present invention; and, FIG. 5 is a top view of the drain removal tool 10, according to a preferred embodiment of the present invention.
Figure 5:
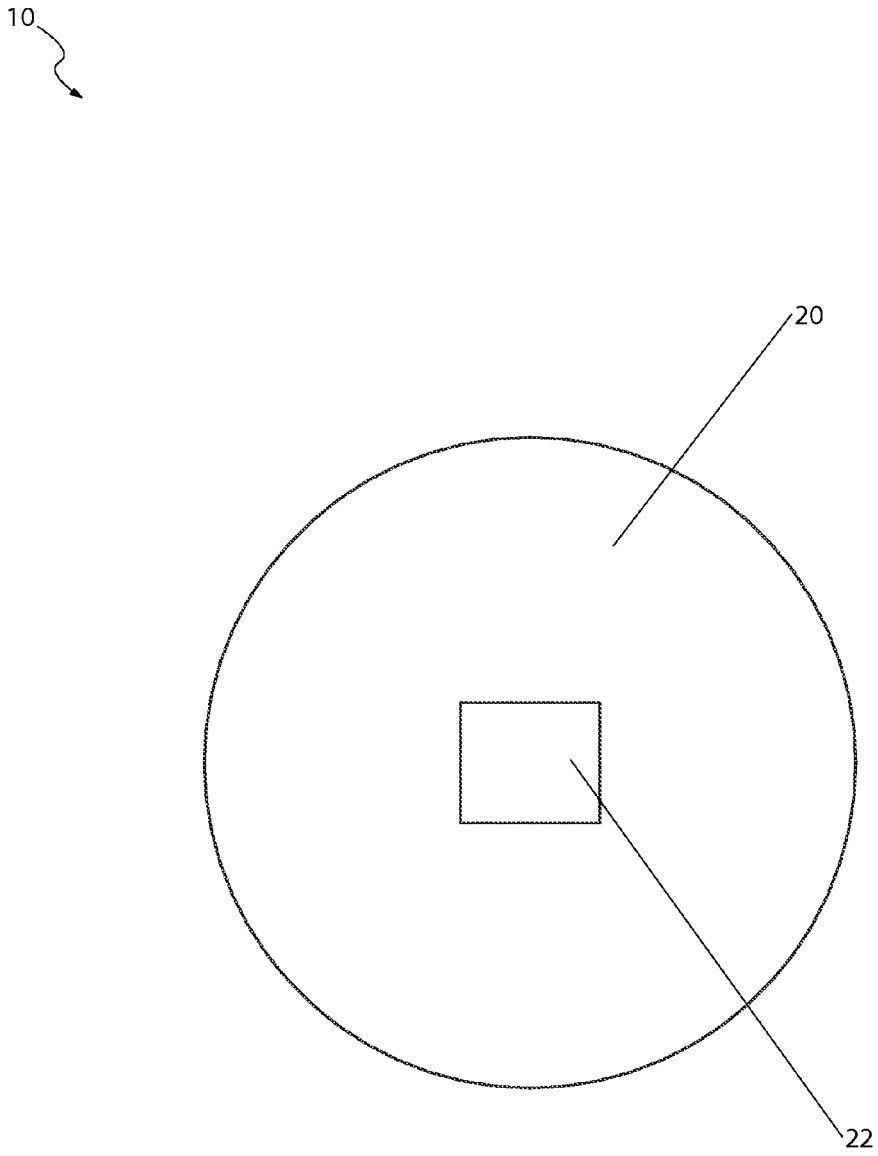

Referring now to FIGS. 1 through 5, various views of the device 10, according to the preferred embodiment of the present invention, are disclosed. FIG. 1 depicts a perspective view of the device 10, FIG. 2 depicts a front view of the device 10 illustrating insertion into the drain flange 12, FIG. 3 depicts a rear view of the device 10, FIG. 4 depicts a bottom view of the device 10, and FIG. 5 depicts a top view of the device 10. The device 10 comprises a head 20 which provides an attachment to an existing tool and a shank 25 which provides an engaging means to the drain flange 12. The device 10 is preferably fabricated from stainless steel, yet other resilient materials may be utilized without limiting the scope of the apparatus 10. The device 10 is preferably utilized with drain flanges 12 which comprise a hollow through-hole, yet alternate drain flanges 12 which comprise a cross-member may also be utilized by removing said cross-member before utilization without limiting the scope of the device 10.

The head 20 comprises a cylindrical shape and further comprises an integrally molded tool attachment recess 22. The tool attachment recess 22 is utilized for interconnection to an existing socket wrench. The socket wrench is preferably a common three-eighths (%) inch mechanical device which includes a fitting to engage common sockets or in this instance to engage the tool attachment recess 22. The outer diameter of the head 20 measures approximately one-and-a-half (1½) inches in diameter, yet other dimensions may be utilized without limiting the scope of the device 10.

Integrally molded to an underside surface of the head 20 is a conically shaped shank 25 which provides an engaging body to a threaded inner surface of the drain flange 12. The conical shape of the shank 25 enables a gradual interconnection of the device 10 to the drain flange 12 which further enables a plurality of threads 27 upon said shank 25 to engage the threads upon said drain flange 12. The threads 27 upon the shank 25 are preferably reversed threads 27 (left-hand threads as opposed to more conventional right-hand threads) which require the device 10 to be inserted into the drain flange 12 in a counter-clockwise direction. The threads 27 also comprise a pointed thread style which enables the device 10 to grip and engage the drain flange 12 and to remove said drain flange 12 from the drain pipe 11, simultaneously. The threads 27 are arranged in an equally spaced spiraling manner over the tapered profile of the shank 25 which enable the device 10 to be inserted into the drain pipe 11.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: acquiring the device 10; engaging the tool attachment recess 22 upon the head 20 with a socket wrench or similar tool; inserting the shank 25 into the drain flange 12 while rotating in a counter-clockwise direction, thereby engaging the threads 27 with the inner surface of said drain flange 12; continuing to rotate to enable the device 10 to remove the drain flange 12 from the drain pipe 11; utilizing as desired; and, utilizing the device 10 to remove drain flanges 12 from sinks, tubs, showers, and similar locations in a manner which is quick, easy, and effective.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A drain flange removal tool, comprising a head portion and a shank portion depending outwardly from said head portion;

wherein said head portion comprises a tool attachment recess centrally disposed on an upper surface of said head portion opposite said shank portion adapted to operably receive an auxiliary tool;

wherein said tool attachment recess is sized to receive a socket wrench such that said socket wrench provides a driving force to said removal tool and said drain flange when said removal tool is inserted within said drain flange;

wherein said shaft portion further comprises threads spirally disposed along an outer surface from an upper end to a terminal end thereof;

wherein said threads are adapted to engage an inner surface of a drain flange to provide a secure frictional contact when said removal tool is inserted within said drain flange thereby providing simultaneous removal of said drain flange and said removal tool when acted upon by said auxiliary tool.

2. The removal tool of claim 1, wherein said head portion further comprises a cylindrical shape having a head diameter.

3. The removal tool of claim 2, wherein said shank portion further comprises a general conical-shaped member having a resilient and durable material of construction tapering from a bottom of said head portion to a terminal end.

4. The removal tool of claim 3, wherein said shaft portion further comprises threads spirally disposed along an outer surface of said shank portion from an upper end of said shank portion to said terminal end;

wherein said threads engage an inner surface of said drain flange to provide said secure frictional contact when said removal tool is inserted within said drain flange; and, wherein said shank portion enables a gradual interconnection of said removal tool to said drain flange.

5. The removal tool of claim 4, further comprising left-hand threads.

6. The removal tool of claim 5, wherein said threads are a pointed thread style.

7. The removal tool of claim 6, wherein said head diameter further comprises approximately 1½ inches.

8. The removal tool of claim 6, wherein said material of construction is stainless steel.

9. The removal tool of claim 6, wherein said tool attachment recess is adapted to receive a socket wrench having a three-eighths ratchet head.

10. The removal tool of claim 1, further comprising left-hand threads.

11. The removal tool of claim 10, wherein said threads are a pointed thread style.

12. The removal tool of claim 10, wherein said head diameter further comprises approximately 1½ inches.

13. The removal tool of claim 10, wherein said material of construction is stainless steel.

14. The removal tool of claim 10, wherein said tool attachment recess is adapted to receive a socket wrench having a three-eighths ratchet head.

15. A method of removing a drain flange having a through-hole of a basin with a removal tool, further comprising the following steps:

providing said removal tool, further comprising:

a head portion, comprising a generally cylindrical shape having a head diameter and a tool attachment recess centrally disposed on an upper surface of said head portion; and, a shank portion comprising a generally conical shape having an upper end depending outwardly from a bottom end of said head portion to a terminal end, further comprising left-hand pointed threads spirally disposed along an outer surface of said shank portion from an upper end of said shank portion to said terminal end;

inserting said drain removal tool into said through hole of said drain flange;

inserting a driving end of an auxiliary tool into said tool attachment recess;

driving said removal tool with said auxiliary tool in a counter-clockwise direction, wherein said threads engage an inner portion of said drain removal tool and firmly grasp said drain removal tool; and, continuing to drive said removal tool in said counter-clockwise direction, thereby enabling said drain flange to simultaneously extract itself from said basin.

16. A method of removing a drain flange having a cross-member of a basin with a removal tool, further comprising the following steps:

providing said removal tool, further comprising:

a head portion, comprising a generally cylindrical shape having a head diameter and a tool attachment recess centrally disposed on an upper surface of said head portion; and, a shank portion comprising a generally conical shape having an upper end depending outwardly from a bottom end of said head portion to a terminal end, further comprising left-hand pointed threads spirally disposed along an outer surface of said shank portion from an upper end of said shank portion to said terminal end;

removing said cross-member from said drain flange, thereby providing access to a through-hole;

inserting said drain removal tool into said through hole of said drain flange;

inserting a driving end of an auxiliary tool into said tool attachment recess;

driving said removal tool with said auxiliary tool in a counter-clockwise direction, wherein said threads engage an inner portion of said drain removal tool and firmly grasp said drain removal tool; and, continuing to drive said removal tool in said counter-clockwise direction, thereby enabling said drain flange to simultaneously extract itself from said basin.

* * * * *